US011577937B2

(12) United States Patent
Novacek

(10) Patent No.: US 11,577,937 B2
(45) Date of Patent: Feb. 14, 2023

(54) METHOD AND APPARATUS FOR MONITORING A STATE OF A PASSENGER TRANSPORT SYSTEM BY USING A DIGITAL DOUBLE

(71) Applicant: INVENTIO AG, Hergiswil (CH)

(72) Inventor: Thomas Novacek, Schwechat (AT)

(73) Assignee: INVENTIO AG, Hergiswil (CH)

( * ) Notice: Subject to any disclaimer, the term of this patent is extended or adjusted under 35 U.S.C. 154(b) by 366 days.

(21) Appl. No.: 16/772,061

(22) PCT Filed: Dec. 7, 2018

(86) PCT No.: PCT/EP2018/083937
§ 371 (c)(1),
(2) Date: Jun. 11, 2020

(87) PCT Pub. No.: WO2019/115378
PCT Pub. Date: Jun. 20, 2019

(65) Prior Publication Data

US 2021/0078834 A1 Mar. 18, 2021

(30) Foreign Application Priority Data

Dec. 14, 2017 (EP) ..... 17207385

(51) Int. Cl.
*B66B 25/00* (2006.01)
*B66B 5/00* (2006.01)

(52) U.S. Cl.
CPC ..... *B66B 25/006* (2013.01); *B66B 5/0025* (2013.01); *B66B 5/0087* (2013.01); *B66B 25/00* (2013.01)

(58) Field of Classification Search
CPC ... B66B 25/006; B66B 5/0025; B66B 5/0087; B66B 25/00
See application file for complete search history.

(56) References Cited

U.S. PATENT DOCUMENTS 7,823,706 B2 * 11/2010 Tyni ..... B66B 5/0031 187/391
8,418,815 B2 * 4/2013 Encinas Carreno .. B66B 5/0025 187/390

(Continued)

FOREIGN PATENT DOCUMENTS

CN 201592932 U 9/2010
CN 103347807 A 10/2013

(Continued)

OTHER PUBLICATIONS

International Search Report for International Application No. PCT/EP2018/083937 dated Apr. 11, 2019.

*Primary Examiner* — Mark A Deuble
(74) *Attorney, Agent, or Firm* — Knobbe Martens Olson & Bear LLP

(57) ABSTRACT

This application relates to a method and an apparatus for monitoring a state of a passenger transport system such as, for example, an escalator. The method includes monitoring the state of the passenger transport system using an updated digital double data record that reflects characterizing properties of components of the passenger transport system in an actual configuration of the passenger transport system in a machine-processable manner after the assembly and installation thereof in a building. The updated digital double data record can be obtained, for example, by accurately surveying the passenger transport system and using signal values from sensors housed in the passenger transport system, and allows conclusions as to the present or future state of the passenger transport system, based on which maintenance measures can be planned efficiently and adequately.

14 Claims, 4 Drawing Sheets

(56) References Cited

U.S. PATENT DOCUMENTS

| | | | | |
|---|---|---|---|---|
| 8,540,057 | B2 * | 9/2013 | Schuster | B66B 5/0006 187/247 |
| 9,556,002 | B2 * | 1/2017 | Wilke | B66B 5/0025 |
| 9,604,818 | B2 * | 3/2017 | Kallioniemi | B66B 5/0025 |
| 9,683,454 | B1 | 6/2017 | Welch et al. | |
| 2012/0138391 | A1 | 6/2012 | Weinberger | |
| 2014/0008152 | A1 * | 1/2014 | Annen | B66B 5/0025 187/247 |
| 2015/0154324 | A1 | 6/2015 | Reilio et al. | |
| 2015/0158699 | A1 | 6/2015 | Pentti et al. | |
| 2016/0247129 | A1 | 8/2016 | Song et al. | |
| 2016/0333854 | A1 | 11/2016 | Lund et al. | |
| 2017/0091791 | A1 | 3/2017 | Srinivasan et al. | |
| 2017/0286572 | A1 | 10/2017 | Hershey et al. | |
| 2018/0227277 | A1 | 8/2018 | Fischer et al. | |

FOREIGN PATENT DOCUMENTS

| | | | |
|---|---|---|---|
| CN | 203865806 | U | 10/2014 |
| CN | 104703904 | A | 6/2015 |
| CN | 106586796 | A | 4/2017 |
| CN | 107161823 | A | 9/2017 |
| DE | 10 2015 217 855 | A1 | 3/2017 |
| JP | H 1067475 | A | 3/1998 |
| JP | 2016222387 | A | 12/2016 |
| WO | WO 2014200464 | A1 | 12/2014 |
| WO | WO 201745789 | A1 | 3/2017 |
| WO | WO 2017137256 | A1 | 8/2017 |
| WO | WO 2019115378 | A1 | 6/2019 |

* cited by examiner

METHOD AND APPARATUS FOR MONITORING A STATE OF A PASSENGER TRANSPORT SYSTEM BY USING A DIGITAL DOUBLE

INCORPORATION BY REFERENCE OF ANY PRIORITY APPLICATION(S)

Any and all applications for which a foreign or domestic priority claim is identified in the Application Data Sheet as filed with the present application are hereby incorporated by reference under 37 CFR 1.57.

TECHNICAL FIELD

The present application relates to a method and an apparatus for monitoring properties of a passenger transport system, such as an elevator, an escalator, or a moving walkway. The application further relates to a passenger transport system equipped with a proposed apparatus, a computer program product configured to carry out the proposed method, and a computer-readable medium storing this computer program product.

SUMMARY

Passenger transport systems in the form of elevators, escalators, or moving walkways are used to convey passengers within edifices or buildings. Sufficient operational safety must always be ensured, but ideally also continuous availability. For this purpose, passenger transport systems are usually checked and/or serviced at regular intervals. The intervals are generally determined based on experience with similar passenger transport systems, wherein the intervals must be selected to be sufficiently short in order to ensure operational security such that a check or maintenance is performed in good time before any safety-endangering operating conditions occur.

In the case of older passenger transport systems, the checks are usually performed completely independently of the actual present state of the passenger transport system. This means that a technician has to visit the passenger transport system and inspect it on site. It is often recognized that no urgent maintenance is necessary. The visit of the technician thus turns out to be superfluous and causes unnecessary costs. On the other hand, in the event that the technician actually recognizes the need for maintenance, an additional journey is required in many cases, since the technician can only determine on site which components of the passenger transport system require maintenance, and thus it is only apparent on site that maintenance or repair is required, for example, that spare parts or special tools are needed.

In the case of newer passenger transport systems, there is already partially a possibility, for example, with the help of sensors and/or by monitoring the active components thereof, for example, by monitoring the operation of a drive machine of the passenger transport system, to obtain notifications in advance and/or from an external control center that a state of the passenger transport system has changed and that a check or maintenance of the passenger transport system seem necessary. This means that maintenance intervals can hereby be extended or adjusted when required. However, even in this case, a technician can usually only recognize by visiting the site whether there is actually a need for maintenance and whether spare parts or special tools may be needed.

Among other things, there may be a need for a method or an apparatus by means of which the monitoring of properties of a passenger transport system can be performed more efficiently, more simply, with less effort, without the need for an on-site inspection and/or more predictably. There may also be a need for a suitably equipped passenger transport system, a computer program product for carrying out the method on a programmable apparatus, and a computer-readable medium having such a computer program product stored thereon.

Such a need can be met with the subject matter according to one of the independent claims. Advantageous embodiments are defined in the dependent claims and in the following description.

According to a first aspect, a method for monitoring properties of a passenger transport system is described, the method comprising at least monitoring the properties of the passenger transport system by using an updated digital double data record. The updated digital double data record shows characterizing properties of components of the passenger transport system in an actual configuration of the passenger transport system in a machine-processable manner after the assembly and installation thereof in a building. By monitoring, changes and trends in the characterizing properties of components can be ascertained and assessed. Here, the updated digital double data records can be created step by step. First, a commissioning digital double data record can be created with planning data, which reflects the characterizing properties of components of the passenger transport system in a planning configuration. The commissioning digital double data record can be created by means of generic component model data records and defined component model data records.

By measuring actual data, which reflects the characterizing properties of components of the passenger transport system in the actual configuration of the passenger transport system directly after the assembly and installation thereof in a building, and by replacing planning data in the commissioning digital double data record with corresponding actual data, a commissioning digital double data record can be converted into a completion digital double data record.

By modifying the completion digital double data record while the passenger transport system is operating, taking into account measurement values that reflects changes in the characterizing properties of components of the passenger transport system during the operation thereof, the completion digital double data record is converted into the updated digital double data record.

To assess the monitoring described above, assessment criteria associated with the characterizing properties of components, such as, for example, maximum chain elongation of conveyor chains, an upper limit of the power consumption of the drive machine, maximum and/or minimum dimensions at wear points and the like may be present. These assessment criteria specify the maximum permissible deviations based on planned values, for example. The characterizing properties of components of the updated digital double data record can be compared with these assessment criteria.

According to a third aspect, a passenger transport system is proposed, which comprises an apparatus according to an embodiment of the second aspect.

According to a fourth aspect, a computer program product is proposed which comprises machine-readable program instructions which, when executed on a programmable apparatus, cause the apparatus to carry out or control a method according to an embodiment of the first aspect.

According to a fifth aspect, a computer-readable medium is proposed, on which a computer program product according to an embodiment of the fourth aspect is stored.

Possible features and advantages of embodiments of the application may be considered, inter alia, and without limiting the invention, as being based on the ideas and findings described below.

As noted above, passenger transport systems have so far mostly been inspected on site in order to be able to recognize whether maintenance or repair is actually currently necessary and, if this is the case, which specific measures need to be taken, for example, which spare parts and/or tools are required.

In order to avoid this, it is proposed to use a so-called updated digital double data record (hereinafter sometimes referred to briefly as "digital double") for monitoring properties characterizing the present state of the passenger transport system. The updated digital double data record is intended to comprise data which characterize the characterizing properties of the components forming the passenger transport system. The data are intended to characterize the properties of the components in their actual configuration, that is to say in a configuration in which the components have been fully completed and then assembled to form the passenger transport system and installed in a building.

In other words, the data contained in the digital double data record do not only reflects the planned properties of the components, such as are assumed, for example, when planning, designing or commissioning the passenger transport system, and such as they can be taken, for example, from CAD data used herein relating to the components. Instead, the data contained in the digital double data record are intended to reflect the actual properties of the components installed in the fully assembled and installed passenger transport system. The digital double can thus be viewed as a virtual image of the finished passenger transport system or the components contained therein.

The data contained in the digital double data record should reflect the characterizing properties of the components in sufficient detail to be able to therefrom derive statements about the present structural and/or functional properties of the entire passenger transport system. In particular, statements about current structural and/or functional properties, which characterize an updated state of the entire passenger transport system, are intended to be derivable on the basis of the digital double, which can be used for an assessment of their present or future operational safety, their present or future availability, and/or a present or future need for maintenance or repair.

The updated digital double data record thus differs, for example, from digital data which are conventionally generated or used in the production of passenger transport systems. For example, when planning, designing, or commissioning a passenger transport system, it is common to plan or design the components used by using computers and CAD programs, so that corresponding CAD data, for example, reflects a planned geometry of a component. However, such CAD data do not indicate which geometry a produced component actually has, whereby, for example, production tolerances or the like can lead to the fact that the actual geometry differs significantly from the planned geometry.

In particular, conventionally used data such as CAD data do not indicate which characterizing properties components have assumed after they have been assembled to form the passenger transport system and installed in a building. Depending on how the assembly and installation were performed, there may be significant changes in the characterizing properties of the components compared to their originally configured planned properties and/or compared to their properties directly after their production, but before their assembly or installation.

The updated digital double data record also differs from data that is conventionally used in part during the production of complex workpieces or machines. For example, DE 10 2015 217 855 A1 describes a method for checking a consistency between reference data of a production object and data of a so-called digital twin of the production object. A digital image of a workpiece, referred to as a digital twin or digital double, is synchronized with the state of the workpiece during production. For the production process, this means that after each production step, the data reproducing the digital twin are modified in such a way that the changes in the properties of the workpiece to be brought about by the production step are to be taken into account.

For example, provision can be made in a production step to remove an area of the workpiece by grinding, turning or the like in accordance with planned specifications, so that after the production step has been carried out, the digital twin is also modified in accordance with the planned specifications. In this way, the digital twin is always intended to provide information about the present intermediate state of the workpiece during the production thereof.

However, particularly in the production of components for passenger transport systems, it is not intended to take into account the digital twin data which reflects the actual characterizing properties of the components, in particular actual characterizing properties of the components after their assembly to form a completed passenger transport system and the installation thereof in the building. Instead, the data housed in the digital twin are mostly based exclusively on planned properties such as can be reflect, for example, in the form of CAD data.

In order to be able to monitor the state of a passenger transport system with sufficient accuracy and/or reliability, or possibly even to forecast it, it is now proposed to provide the data used for this purpose in the form of the updated digital double data record. The digital double provides information that goes beyond mere planned properties about the characterizing properties of the components installed in the passenger transport system in their actual configuration. Such information can advantageously be used, for example, to be able to recognize deviations in the actual characterizing properties from originally designed characterizing properties of the passenger transport system. Appropriate conclusions can then be drawn from such deviations, for example, whether there is already a need for maintenance or repair of the passenger transport system, whether there is a risk of increased or premature wear, etc. For example, the deviations can arise from production tolerances that occur during the production of the components, from changes in the characterizing properties of the components during the assembly of the components or during the installation thereof in the building, and/or from changes in the characterizing properties of the components that occur during the final operation of the passenger transport system, said changes resulting, for example, from wear.

Due to the fact that the updated digital double data record, like a virtual digital copy of the actual passenger transport system, allows conclusions to be drawn about the characterizing properties currently prevailing in the passenger transport system, information can at best be obtained solely by analyzing and/or processing the updated digital double data record which allow conclusions to be drawn about the current state of the passenger transport system and in particular conclusions about any maintenance or repair that may be necessary. Information about which spare parts and/or tools are needed for upcoming maintenance or repair can even be derived.

The updated digital double data record can be stored, analyzed, and/or processed in a computer configured for carrying out the method proposed here or in a corresponding data processing system. In particular, the computer or the data processing system can be arranged remotely from the passenger transport system to be monitored, for example, in a remote monitoring center.

Accordingly, the use of the updated digital double data record makes it possible to monitor properties characterizing the state of the passenger transport system continuously or at suitable time intervals, in particular to recognize changes that make maintenance or repair appear necessary. If necessary, specific information regarding work to be carried out during maintenance or repair can be derived from this based on an analysis of the digital double alone, without a technician actually having to inspect the passenger transport system on site. Hereby, considerable effort and costs can be reduced.

According to one embodiment, the updated digital double data record comprises data which has been ascertained by measuring characterizing properties of the completed passenger transport system.

In other words, the data contained in the updated digital double data record are not only intended to reflect the planned properties of the components of the passenger transport system, such as, for example, when planning, designing, or commissioning the passenger transport system based on specifications such as those specified by the customer commissioning the passenger transport system or how they result from the conditions prevailing at the installation location for the passenger transport system. Such planned properties can be configured purely on the computer or on a drawing board and mostly represent ideal properties of the passenger transport system, as are assumed during the planning phase. In practice, however, the components actually produced already differ from such planned specifications after their production and their properties usually change further during assembly and installation in the building.

Therefore, the updated digital double data record should preferably not comprise any, or at least not exclusively, planned data, but rather data ascertained by measuring characterizing properties on the completed passenger transport system, that is to say actual data after the assembly and installation of the passenger transport system.

The characterizing properties of the components can be surveyed, for example, with the aid of separate measuring apparatuses after the completion of the individual components, after the assembly of the components, and/or after the installation of the passenger transport system in the building. Such separate measuring apparatuses can in principle, for example, be simple devices such as measuring tapes, rulers, gauges, scales, etc., by means of which a technician can survey the components. Measurement results can then be stored in the updated digital double data record. However, the measurement processes are preferably not performed manually, but rather by machine. The measuring apparatuses can be configured for the automated measurement of characterizing properties of the components. For example, the components can be surveyed using robots. In particular, various measurement methods can be used, for example non-contact measurement methods based, for example, on surveying by means of light beams, surveying by analyzing image recordings of the components, etc.

As an alternative to separate measuring apparatuses, the characterizing properties of the components can be surveyed, for example, by measuring apparatuses integrated in the passenger transport system, in particular, by integrated sensors. Such integrated measuring apparatuses or sensors can be integrated into individual components, be arranged on individual components or between a plurality of components of the passenger transport system or be temporarily stored between components of the passenger transport system and, for example, areas of the buildings accommodating the passenger transport system. The measuring apparatuses or sensors can, for example, deliver signals which change when the characterizing properties of the respective components to be monitored change. By monitoring the signals, information about currently changing characterizing properties can thus be obtained within the passenger transport system. Measurement values derived from the signals can be obtained without, for example, a technician having to perform manual surveying and thus in particular without the technician having to inspect the passenger transport system on site. In addition, sensors can be provided at suitable points during the planning and assembly or installation of the passenger transport system in order to be able to survey actual properties there in the completed passenger transport system relating to the components housed therein, which otherwise may not be accurate or not precise enough or only could be measured with great effort in the completed passenger transport system.

According to one embodiment of the application, the characterizing properties to be taken into account when creating the updated digital double data record are geometric dimensions of the components, weights of the components, material properties of the components, and/or surface properties of the components.

In other words, a plurality of different characterizing properties of one component or of a plurality of components of a passenger transport system can be surveyed and the measurement results obtained can be stored as data in the digital double data record. Geometric dimensions of the components can be, for example, a length, a width, a height, a cross section, radii, fillets, etc. of the components. Material properties of the components can be, for example, a type of material used to form a component or a partial area of a component. Furthermore, material properties can also be strength properties, hardness properties, electrical properties, magnetic properties, optical properties, etc. of the components. Surface properties of the components can be, for example, roughness, textures, coatings, colors, reflectivities, etc. of the components.

The characterizing properties can relate to individual components or component groups. For example, the characterizing properties can relate to individual components, from which larger, more complex component groups are composed. As an alternative or in addition, the properties can also relate to more complex devices composed of a plurality of components, such as drive motors, gear units, conveyor chains, etc.

The characterizing properties can be ascertained or surveyed with high precision. In particular, the characterizing properties can be ascertained or surveyed with a precision that is more precise than the tolerances to be observed during the production of the components.

According to one embodiment, monitoring the properties of the passenger transport system comprises simulating future characterizing properties of the passenger transport system by using the updated digital double data record.

In other words, it is intended that not only the properties currently prevailing in the passenger transport system can be monitored with the aid of the updated digital double record, but also conclusions about the characterizing properties that will prevail in the passenger transport system in the future can be drawn by means of simulations to be carried out by using the updated digital double data record.

The simulations can be carried out on a computer system. With the aid of the simulations, conclusions can be drawn about a temporal development in the represented characterizing properties and thus forecasts or extrapolation relating to future characterizing properties of the components, based on the data currently contained in the updated digital double data record and, if appropriate, taking into account data previously contained in the updated digital double data record. In the case of simulations, natural law conditions as well as experience with other passenger transport systems can be taken into account.

For example, simulations can take into account how, for example, wear-related changes in the characterizing properties of components have an effect on further changes in these characterizing properties that are expected in the future. As an alternative or in addition, the simulations can take into account experiences gained from experiments and/or by observing other passenger transport systems and from which, for example, a statement can be derived as to when a change in the characterizing properties of a component that has occurred or is expected in the future for the function of the entire passenger transport system should be regarded as substantial, so that suitable measures should be initiated, for example, as part of maintenance or repair.

According to one embodiment of the application, the method proposed here can further comprise planning maintenance work to be carried out on the passenger transport system based on the monitored properties of the passenger transport system.

In other words, the information obtained when monitoring the properties of the passenger transport system according to the application can be used in order to be able to appropriately plan future maintenance work, including any necessary repairs. It can be of advantage here that just by analyzing the updated digital double data record, valuable information can already be obtained, for example, about which changes have occurred in a monitored passenger transport system and/or which wear and tear on components of the passenger transport system must actually be expected. This information can be used to carry out maintenance work, for example, with regard to a time of maintenance and/or with regard to activities to be carried out during maintenance and/or with regard to spare parts or tools to be maintained during maintenance, and/or with regard to maintenance technicians who may need to have special skills or knowledge to be able to plan. In most cases, the planning of the maintenance work can take place purely based on an analysis of the updated digital double data record, that is, without a technician having to inspect the passenger transport system on site.

According to a further embodiment of the application, the proposed method further comprises assessing the quality properties of a component type of a component based on an analysis of updated digital double data records of a plurality of passenger transport systems containing the component in question.

In other words, it is proposed to use the updated digital double data records relating to a plurality of different passenger transport systems and to analyze them in such a way that information is collected and analyzed relating to a single component type of a component installed in the passenger transport systems (or its defined component model data record). The analysis can comprise, for example, comparing the actual values with regard to the characterizing properties of the component in its actual configuration after the assembly and installation of the passenger transport system with previously assumed planned values and, if necessary, taking into account tolerance values assigned to these planned values. Not only the actual values of an individual component are compared here with the planned values for this component. Rather, the actual values of a plurality of components of the same component type are compared with the planned values of this component type.

Through a suitable, for example statistical, analysis, information can thus be obtained that not only allows a statement about the quality of a single component, e.g., whether a single component corresponds to the planned values within acceptable tolerances, but also a statement can be derived about the quality properties of the component type, e.g., quality properties that apply to a plurality of components of this component type.

The fact that the updated digital double data records reflect the characterizing properties of the components in their actual configuration after assembly and installation has an advantageous effect. The analysis of the updated digital double data records thus allows a statement to be made about the characterizing properties of components not only directly after their production, but also after they have been assembled and installed to form the passenger transport system and have undergone changes in their initial characterizing properties.

The method can be implemented particularly advantageously if changes in the characterizing properties of the components during the operation of the passenger transport system are also tracked when the digital double data records are created (as will be described in more detail below). In this case, statistical statements of how the component behaves in real use can be derived from the analysis of a plurality of updated digital double data records from various passenger transport systems containing the component in question. This allows conclusions to be drawn about the quality properties of the component type, which also reflect the qualities thereof during use (robustness of the design).

For example, from the frequent occurrence of excessive wear and tear or even defects in components of a component type, which after their production have satisfactorily met the planned specifications for this component type, it can be concluded that the design of the component type in question already has quality defects that lead, for example, to recurring problems in real operation. For example, already in the design of a component type it can be recognized that excessive changes, in particular excessive wear, occur in this component type after the assembly and installation of the passenger transport system or at the latest during its operation, which lead to a short service life of the components of this type. Thereupon, the design of the component type can possibly be suitably changed in order to minimize the signs of wear, that is to say to increase its robustness, and to increase the service life of the component type.

According to one embodiment of the present application, the proposed monitoring method also comprises creating the updated digital double data record. The creation of the updated digital double data record comprises at least the following steps, but preferably not strictly in the order given:

(i) creating a commissioning digital double data record with planned data, which reflects characterizing properties of components of the passenger transport system of the passenger transport system in a planned configuration;

(ii) creating a completion digital double data record based on the commissioning digital double data record by measuring actual data, which reflects characterizing properties of components of the passenger transport system in the actual configuration of the passenger transport system directly after the assembly and installation thereof in a building and replacing of planned data in the commissioning digital double data record with corresponding actual data; and (iii) creating the updated digital double data record based on the completion digital double data record by modifying the completion digital double data record during the operation of the passenger transport system taking into account measurement values, which reflects changes in the characterizing properties of components of the passenger transport system during operation.

In other words, the updated digital double data record can be created in a plurality of sub-steps. The data contained in the digital double data record can be successively refined and specified, and thus the characterizing properties of the components installed in the passenger transport system can be reflected more and more precisely with regard to their actual present configuration.

For this purpose, the creation of a commissioning digital double data record is started. In this commissioning digital double data record, initially only planned data are stored, which are ascertained when planning or commissioning the passenger transport system. These planned data can be obtained, among other things, if, for example, computer-assisted commissioning tools are used to calculate the characterizing properties of a passenger transport system to be produced, depending on customer specifications. For example, data relating to planned dimensions, planned numbers, planned material properties, planned surface properties, etc. of components to be used in the production of the passenger transport system can be stored in the commissioning digital double data record.

The commissioning digital double data record thus represents a virtual image of the passenger transport system in its planning phase or commissioning phase, that is, before the passenger transport system is actually produced and installed.

Further details on possible method variants that can be used when creating the commissioning digital double data record are explained below.

Based on the commissioning digital double data record, the planned data contained therein can then be successively replaced by actual data and a completion digital double data record can be generated. The actual data indicate characterizing properties of the components of the passenger transport system, which are initially only defined with regard to their planned configuration, in their actual configuration directly after the assembly of the passenger transport system and the installation thereof in the building. The actual data can be ascertained by manual and/or mechanical surveying of the characterizing properties of the components. For this purpose, separate measuring apparatuses and/or sensors integrated in components or arranged on components can be used.

The completion digital double data record thus represents a virtual image of the passenger transport system directly after its completion, e.g., after the assembly of the components and the installation in the building.

In order not only to have a virtual image of it immediately after the completion of the passenger transport system, the completion digital double data record created at this point in time is updated continuously or at suitable intervals during the subsequent operation of the passenger transport system. For this purpose, the data initially stored in the completion digital double data record are modified during operation of the passenger transport system in such a way that observed changes in the characterizing properties of the components forming the passenger transport system are taken into account.

For this purpose, sensors can be provided in the passenger transport system as measuring devices, by means of which the characterizing properties to be observed can be monitored. Such sensors can monitor geometric dimensions of individual or multiple components, for example. Alternatively or in addition, sensors can measure forces acting between components, temperatures prevailing on components, within components or mechanical stresses acting between components, electrical and/or magnetic fields prevailing on components, and much more.

Changes over time in the measurement values supplied by the sensors indicate changes in the observed characterizing properties, whereupon the data contained in the digital double data record can be modified accordingly. The digital double data record modified in this way thus represents a virtual image of the passenger transport system during its operation and taking into account, for example, wear-related changes in comparison to the characterizing properties originally measured directly after completion, and can thus be used as an updated digital double data record for continuous or repeated monitoring of the properties of the passenger transport system.

Logically, all of the characterizing properties of a component that are present as planned data do not necessarily have to be updated by actual data of the component. As a result, the characterizing properties of most components of a completion digital double data record or updated digital double data record are characterized by a mixture of planned data and actual data.

According to one embodiment of the application, the creation of the commissioning digital double data record comprises the creation of commissioning data taking into account customer specifications and the creation of production data by modifying the commissioning data taking into account production specifications.

In other words, both customer specifications and production specifications should be taken into account when initially creating the commissioning digital double data record. As a rule, the commissioning data are first created taking into account the customer specifications and then these commissioning data are modified or refined taking into account the production specifications. Possibly, the creation of the commissioning digital double data record can also iteratively comprise a multiple calculation and modification of commissioning data taking into account the customer and/or production specifications.

Customer specifications can be understood to mean specifications which are specified by the customer in individual cases, for example when ordering the passenger transport system. The customer specifications typically relate to a single passenger transport system to be produced. For example, the customer specifications can comprise prevailing spatial conditions at the installation location, interface information for attachment to supporting structures of a building, etc. In other words, the customer specifications can specify, for example, what length the passenger transport system should have, what height difference should be overcome, how the passenger transport system should be connected to supporting structures within the edifice, etc. Customer specifications can also comprise customer requirements with regard to functionality, conveying capacity, optics, etc. The commissioning data can be present, for example, as a CAD data record which, inter alia, reflects geometric dimensions and/or other characterizing properties of the components forming the passenger transport system as the characterizing properties.

The production specifications typically relate to properties or specifications within a production factory or production line in which the passenger transport system is to be produced. For example, depending on the country or location in which a production factory is located, various conditions may exist in the production factory and/or requirements may have to be met. For example, in some production factories certain materials, raw materials, raw components or the like may not be available or may not be processed. In some factories, machines can be used that are missing in other factories. Due to their layout, some factories are subject to restrictions with regard to the passenger transport systems or components thereof to be produced. Some production factories allow a high degree of automated production, whereas other production factories can use manual production, for example due to low labor costs. There may be a multitude of other conditions and/or requirements relative to which production environments can differ. All of these production specifications typically have to be taken into account when planning or commissioning a passenger transport system, since it can depend on them in which way a passenger transport system can actually be built. If necessary, it may be required to fundamentally modify the commissioning data initially created, which only took customer specifications into account, in order to be able to take the production specifications into account.

According to one embodiment of the application, when the commissioning data is created, a virtual image of the passenger transport system is generated using generic component model data records of the passenger transport system and including the customer specifications.

In other words, it can be advantageous to create a virtual image of the passenger transport system during the initial commissioning or planning of the passenger transport system, taking into account the customer specifications, in which the components forming the passenger transport system are reflected, for example, with regard to their planned properties. The virtual image can be configured as a kind of wire frame or wire mesh. Components to be used can form structures of this wire frame or mesh. The image of the entire passenger transport system can be composed of predefined component model data records and generic component model data records.

The defined component model data records can be data records that reflects a planned configuration of individual components with regard to all the characterizing properties that are substantial for the production of the passenger transport system. A defined component model data record can thus be used like part of a modular system, since it always has or defines the same characterizing properties, and can be used as part of the wire frame to be formed.

In contrast to this, the generic component model data records can be data records that reflects a planned configuration of a plurality of different components with regard to a plurality of properties that are substantial for the production of the passenger transport system such that data can be added to a generic component model data record by taking into account the previously entered customer specifications that it reflects or defines an individual component with regard to all the characterizing properties that are substantial for the production of the passenger transport system.

For example, a component to be installed in a passenger transport system, such as, for example, an upper strap of a framework of an escalator, can be configured having different lengths depending on the required length of the passenger transport system. The generic component model data record is thus already sufficiently defined in terms of many of its characterizing properties, but not in terms of its length. The length of this component must then be selected or calculated appropriately when commissioning the passenger transport system based on the customer-specific configuration data.

According to one embodiment of the application, static and/or dynamic simulations are performed when creating the commissioning data and the commissioning digital double data record is created taking into account the results of the simulations.

In other words, to create the commissioning data, which, taking into account the customer specifications, form the basis of the commissioning digital double data record, simulations can be performed with which static and/or dynamic properties of the commissioned passenger transport system are simulated. For example, simulations can be performed in a computer system.

Static simulations analyze, for example, a static interaction of a plurality of assembled components. With the help of static simulations, it can be analyzed, for example, whether complications can arise during the assembly of a plurality of defined component model data records or component model data records which are specified accordingly based on generic component model data records, for example, because each of the components is produced according to the characterizing properties stored in the component model data record with certain production tolerances, such that problems can arise in the event of an unfavorable summation of production tolerances.

Dynamic simulations, for example, analyze the dynamic behavior of components during the operation of the assembled passenger transport system. By means of dynamic simulations, for example, it is possible to analyze whether moving components within a passenger transport system can be shifted in a desired manner or whether, for example, there is a risk of collisions between moving components.

According to a specific embodiment of the invention, the passenger transport system is an escalator or a moving walkway. In this case, the components of the passenger transport system are preferably components of a framework and components of a conveyor. The components of a framework can be upper straps, lower straps, uprights, cross struts, diagonal struts, gusset plates, support angles and/or framework separation points. The components of a conveyor can be driving stages, driving pallets, conveyor chains, conveyor belts, drive machines, service brakes and/or controllers.

In other words, a passenger transport system in the form of an escalator or moving walkway can be composed of a plurality of components which, on the one hand, form a framework, which represents a supporting structure of the passenger transport system, and, on the other hand, form a conveyor which is held by the framework and with the help of which passengers can be transported along a travel path. Both the framework and the conveyor are intended to be monitored for their properties during their operation, for example in order to be able to determine changes in good time that could endanger operational safety and/or the availability of the escalator or moving walkway.

Specific embodiments of how an updated digital double data record can be created for an escalator or moving walkway and how the state of the escalator or moving walkway can be monitored based thereon are set out below with reference to preferred embodiments.

According to an alternative embodiment of the application, the passenger transport system is an elevator. The components of the passenger transport system can be components of a support structure and/or components of a conveyor structure. The components of the support structure can be guide rails, wall fastenings, drive frames, floor fastenings, cross struts, longitudinal struts, and/or diagonal struts. The components of a conveyor structure can be elevator cabs, counterweights, suspension means, drive machines, braking apparatuses, and/or controllers.

Creation of the updated digital double data record for the elevator and monitoring of the state of the elevator can be configured in an analogous manner, as is described here primarily for the configuration of the passenger transport system as an escalator or moving walkway.

Embodiments of the method presented here for monitoring the state of a passenger transport system can be performed using an apparatus specially configured for this purpose. The apparatus can comprise one or more computers. In particular, the apparatus can be formed from a computer network which processes data in the form of a data cloud. For this purpose, the apparatus can have a storage device in which the data of the digital double data record can be stored, for example in electronic or magnetic form. The apparatus can also have data processing options. For example, the apparatus can have a processor, by means of which data of the digital double data record can be processed. The apparatus can furthermore have interfaces via which data can be input into and/or output from the apparatus. In particular, the apparatus can be connected to sensors which are arranged on or in the passenger transport system and by means of which the characterizing properties of components of the passenger transport system can be measured. The apparatus can in principle be part of the passenger transport system.

However, the apparatus is preferably not arranged in the passenger transport system, but rather remote from it, for example in a remote control center, from which the state of the passenger transport system is to be monitored. The apparatus can also be implemented in a spatially distributed manner, for example if data are processed in a data cloud and distributed over a plurality of computers.

In particular, the apparatus can be programmable, that is to say it can be caused by a suitably programmed computer program product to execute or control the method according to the application. The computer program product can contain instructions or code which, for example, cause the processor of the apparatus to store, read, process, modify, etc. data of the digital double data record. The computer program product can be written in any computer language.

The computer program product can be stored on any computer-readable medium, for example a flash storage device, a CD, a DVD, RAM, ROM, PROM, EPROM, etc. The computer program product and/or the data to be processed with it can also be stored on a server or a plurality of servers, for example a data cloud, from where they can be downloaded via a network, for example the Internet.

Finally, it is pointed out that some of the possible features and advantages of the disclosure are described herein with reference to different embodiments of both the proposed method and the correspondingly configured apparatus for monitoring properties of a passenger transport system. A person skilled in the art recognizes that the features can be combined, transferred, adjusted, or replaced in a suitable manner in order to arrive at further embodiments of the disclosure.

BRIEF DESCRIPTION OF THE DRAWINGS

Embodiments of the disclosure will be described in the following with reference to the accompanying drawings, although neither the drawings nor the description should be construed as limiting the invention.

The drawings are merely schematic and not true to scale. Like reference signs refer to like or equivalent features in the various drawings

DETAILED DESCRIPTION

First, passenger transport systems to be monitored are described briefly and only very schematically with regard to the components used therein.

Figure 1:
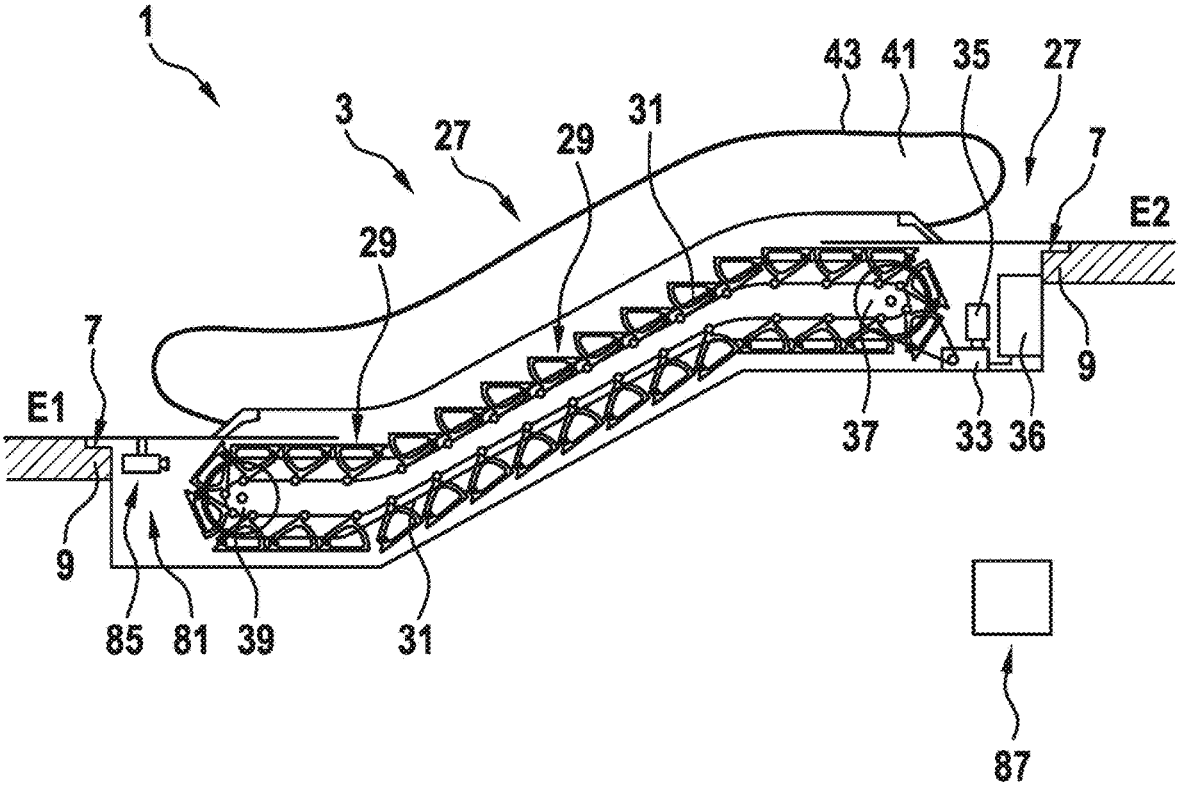
FIG. 1 shows a passenger transport system in the form of an escalator, with respect to which a method according to the disclosure can be carried out.
Figure 2:
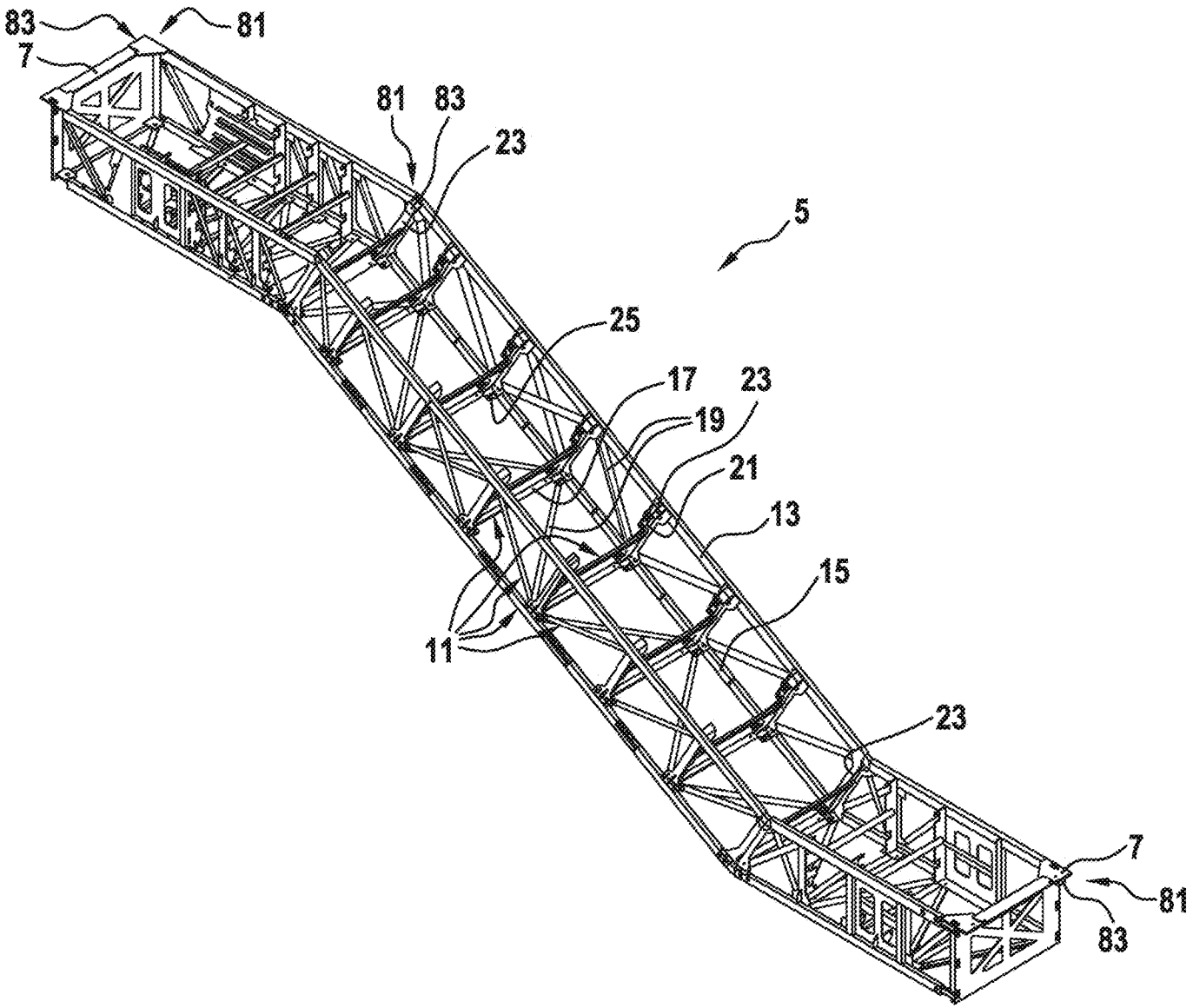
FIG. 2 shows a supporting framework for an escalator.

FIG. 1 shows a passenger transport system 1 in the form of an escalator 3, the state of which can be monitored using the method described herein. FIG. 2 shows a supporting framework 5 of an escalator 3, which is not shown in FIG. 1 for reasons of clarity.

The escalator 3 connects areas E1 and E2 in a building which are arranged at different heights and horizontally spaced apart from one another. The framework 5 here forms a supporting structure and abuts at the opposite ends thereof with the support angles 7 on the support points 9 of the building. The framework 5 comprises a plurality of components 11, in particular of upper straps 13, lower straps 15, cross struts 17, diagonal struts 19, uprights 21, framework separation points 23 and gusset plates 25. Many of the components 11 of the framework 5 comprise at least partially elongated metal profiles. Dimensions of the components 11 are selected so that the framework 5 can span a space between opposite support points 9 of the building on the one hand and on the other hand is sufficiently stable to withstand the forces acting on the escalator 3 formed with the framework 5.

The escalator 3 comprises a conveyor 27, which is held by the framework 5 and by means of which passengers can be transported between the two areas E1 and E2. The conveyor 27 comprises, among other things, driving stages 29, conveyor chains 31, a drive machine 33, a service brake 35, a controller 36, deflection sprockets 37 driven by the drive machine 33 and deflection disks 39. The escalator 3 further comprises a balustrade 41 having a handrail 43 running thereon.

Alternatively, the passenger transport system 1 can also be configured as a moving walkway (not shown) which is constructed similarly or identically to an escalator 3 with regard to many of its components 11.

Figure 3:
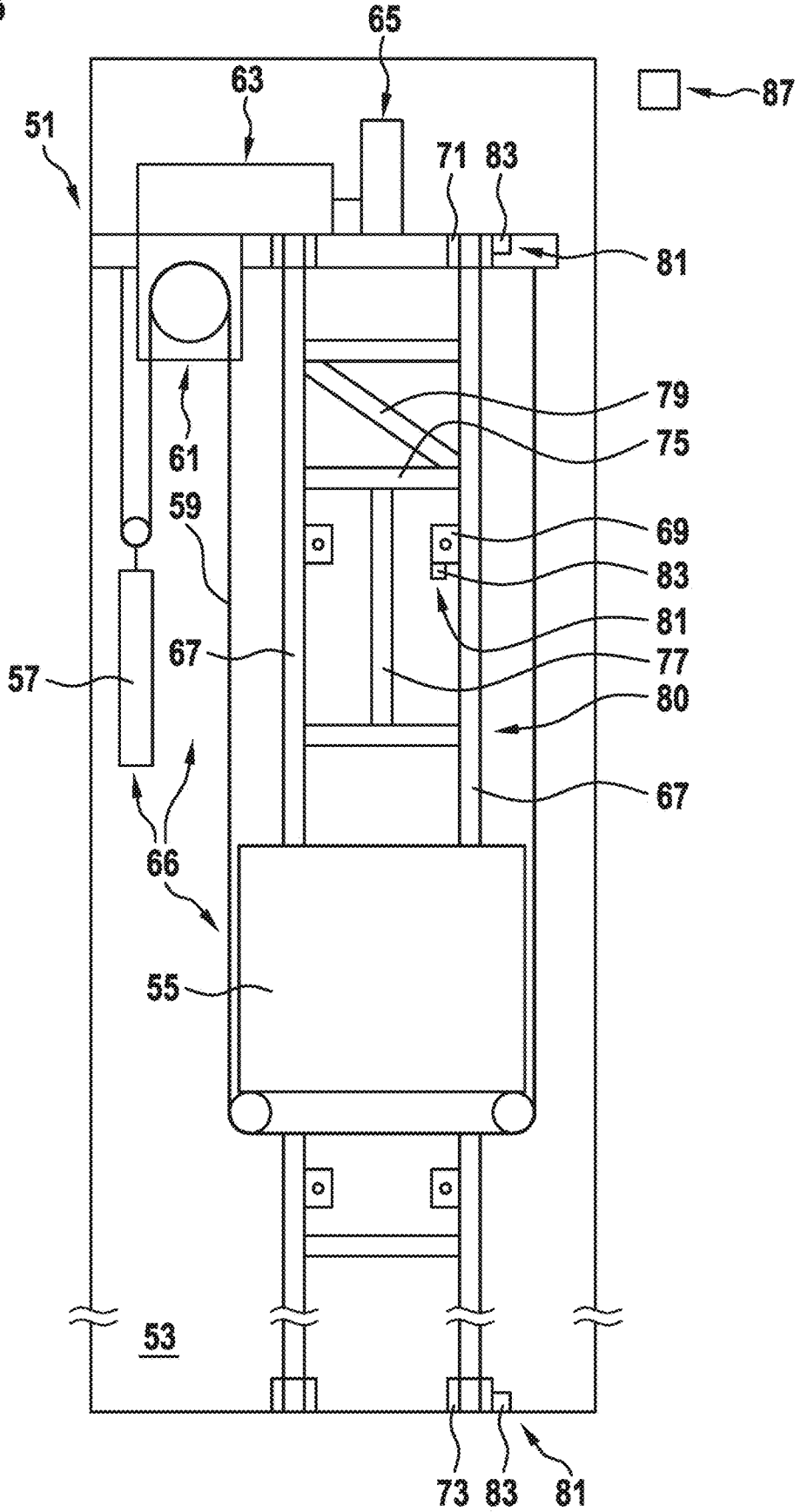
FIG. 3 shows a passenger transport system in the form of an elevator, with respect to which a method according to the disclosure can be carried out.

In a further alternative embodiment, the passenger transport system 1 is configured as an elevator 51. An elevator 51 is shown by way of example in FIG. 3. The elevator 51 has an elevator shaft 53 in which a conveyor 66 and a support structure 80 holding this conveyor 66 are housed. An elevator cab 55 and a counterweight 57 are suspended from suspension means 59 in the form of belts. A drive machine 61 and a braking apparatus 63 drive the suspension means 59 or brake them if necessary. A controller 65 controls the operation of the elevator 51. The elevator cab 55 and possibly also the counterweight 57 are guided by guide rails 67 as they move through the elevator shaft 53. The guide rails 67 are connected to supporting structures within the elevator shaft 53 via wall fastenings 69 and floor fastenings 73. Furthermore, cross struts 75, longitudinal struts 77, and diagonal struts 79 may ensure sufficient mechanical stabilization of the guide rails 67. The guide rails also carry a drive frame 71 to which the ends of the suspension means 59 and the drive machine 61, the braking apparatus 63, and the controller 65 are fastened.

The product life cycle of an escalator 3, a moving walkway, or an elevator 51 is accompanied by various software systems and databases. These are generally not linked to one another to such an extent that the data they contain is automatically available throughout all systems. Although product development, order-specific configuration through sales and production documents and data specified on the basis of this configuration are already more or less well interlinked, there is generally no consistent support and documentation in the after-sales area. This can lead, for example, to the fact that a service technician often first has to examine a passenger transport system 1 on site in order to then carry out appropriate measures, such as, for example, procure the required material, set deadlines for maintenance and repair, dispose of the dismantled material properly, etc.

The method according to the disclosure provides for the real product to be accompanied by a digital double, preferably continuously for the entire product life cycle, e.g., not only during the manufacture of the passenger transport system 1, but also after its completion and during its subsequent operation.

An updated digital double record representing the digital double can be created as a commissioning digital double data record, for example using CAD data used during planning, during the production process based on commissioning data, taking into account customer specifications. Components can be commissioned based on previously defined component model data records or generic component model data records.

The commissioning digital double data record can then be modified taking into account production specifications. The commissioning digital double data record comprises hereby planned data that represent a virtual image of the passenger transport system 1 to be produced. The passenger transport system 1 can then be produced based on the commissioning digital double data record.

After completion of the passenger transport system 1, the planned data contained in the commissioning digital double data record can be replaced or supplemented by actual data, such as can be obtained by surveying the actual configuration of the passenger transport system 1 produced. The completion digital double data record is hereby created.

This completion digital double data record already contains data which reflect the characterizing properties of the components 11 installed in the passenger transport system 1 in their actual configuration, e.g., after the passenger transport system has been completed and installed in the building. The completion digital double data record can thus already be used as an updated digital double data record for monitoring properties of the passenger transport system 1. For this purpose, the completion digital double data record can be stored and processed, for example, in a monitoring apparatus 87, which can be arranged in a remote control center.

For example, the actual values of component properties contained in the completion digital double data record, as they actually exist in the passenger transport system 1, can be compared with planned values assumed during commissioning. Conclusions about properties of the passenger transport system 1 to be expected in the future can be drawn, for example, from any differences between the actual values and the planned values. For example, based on such differences, it can be predicted when certain signs of wear are to be expected, which in turn can be used to estimate when and/or how first maintenance measures are likely to be necessary. In other words, based on the completion digital double data record, an estimation or simulation of future characterizing properties of the passenger transport system 1 can take place and maintenance work to be carried out in the future can thus be planned. Additionally, assessment criteria associated with the characterizing properties of components, such as a maximum chain elongation of conveyor chains 31, an upper limit of the power consumption of the drive machine 33, maximum and/or minimum dimensions at wear points and the like, can be stored in the monitoring device 87. These specify the maximum permissible deviations based on the planned values of the characterizing properties of components. The characterizing properties of components of the updated digital double data record can then also be compared with these assessment criteria.

In order to be able to provide a digital double of the passenger transport system 1 even during operation, at least some of the data contained in the completion digital double data record are updated from time to time during the operation of the passenger transport system. For this purpose, sensors can be provided in the passenger transport system 1, by means of which measurement values can be ascertained which reflects changes in the characterizing properties of components 11 of the passenger transport system 1 during their operation Taking these measurement values into account, the data contained in the completion digital double data record can be modified. The updated digital double data record generated in this way thus also represents a virtual image of a continuously updated state of the passenger transport system 1 in its actual configuration during operation.

By using the digital double, statements about the present prevailing state of the passenger transport system 1, for example by comparison with setpoints or expected values, as well as statements about a future state of the passenger transport system 1, for example by means of simulations or extrapolations based on the data of the updated digital double data record can thus be made. Hereby, for example, maintenance work to be carried out can be planned according to the situation and in a targeted manner.

In order to be able to measure the currently prevailing actual characterizing properties of components 11 in the passenger transport system 1, various sensors 81 can be provided in the passenger transport system 1, by means of which certain characterizing parameters can be monitored, which allow conclusions to be drawn about changes in the characterizing properties of the components 11 of the passenger transport system 1. A plurality of different sensors 81 can generally be used for this purpose. Force sensors 83 are shown in the elevator 51 only by way of example, which can measure forces acting on the various wall fastenings 69, on the drive frame 71 and floor fastenings 73, as a result of which conclusions can be drawn with regard to forces acting on the guide rails 61 and thus, for example, any mechanical tension. For a passenger transport system 1 in the form of an escalator 3, a camera system 85 is only shown by way of example, by means of which the state of, for example, driving stages 29 or the conveyor chains 31 can be monitored for any wear that may occur. In addition, force sensors 83 can also be provided in the framework 5, for example, similarly to the elevator 51. The sensors can transmit the signals thereof to the monitoring apparatus 87, for example by wire or via a radio network.

In summary and in other words, the creation of the digital double can be started first, for example by creating a digital double in the engineering stage from specific and generic component model data records, including the customer specifications (e.g., an order-specific, generated parts list, as it is sometimes called) EBOM ("Engineering Bill of Materials"). The generic component model data records contain component data such as their dimensions, tolerances, surface structures, other characterizing properties, interface information on adjacent components and the like. Various simulations such as static simulations, for example in the form of tolerance considerations, and dynamic simulations, for example for collision checking, can then be carried out. From the order-specific, generated parts list (EBOM), a production-compatible parts list (production BOM—MBOM) and the associated production data are generated by applying production-specific rules.

As an example of the interaction of generic component model data records and the customer specification, the generation of an order-specific generated parts list (EBOM) of a framework 5 for the escalator 3 can be used. The customer defines in his customer specification the information relevant for the design of the framework 5, such as an area of application (department store, public building such as a train station, subway etc.), a head, a step width (and thus a funding capacity), a length (an angle of the inclined area between the access areas is ascertained from the length and the conveying height) and the type of balustrade (e.g. glass balustrade, balustrade for traffic stairs). The individual component parts 11 of the framework 5, such as upper straps 13, lower straps 15, cross struts 17, support angles 7, framework separation points 23, etc., and defined component model data records such as uprights 21, diagonal struts 19, gusset plates 25, etc. are present as generic component model data records, wherein, for example, the length of the upper straps 13 and lower straps 15, the length of the cross struts 17 and the number of uprights 21 are dependent on the customer specifications. According to the entered customer specifications, the individual components 11 of the framework 5 with their specific dimensions are generated from the generic and defined component model data records. The design is carried out, for example, in such a way that a so-called virtual wire frame of the framework 5 is created by means of the customer specifications "delivery height," "horizontal spacing of the support angles," "step width," and/or "delivery capacity." The individual components 11 are now configured on the basis of this virtual wire frame, in particular with regard to their dimensions, in particular their lengths, and their number. The customer specifications also show how many framework separation points 23 are to be made so that the escalator 3 can be brought into the edifice in segments, for example. Because of the framework separation points 23, other parts may be required and the upper straps 13 and lower straps 15 must generally consist of multiple parts.

In an analogous manner, an EBOM can also be created for an elevator 51 by ascertaining a planned configuration for a conveyor 66 and a support structure 80, taking into account customer specifications. For example, a size of the elevator cab 55, a weight of the counterweight 57, a design of the suspension means 59, the drive machine 61 and the braking apparatus 63, and the controller 65 can be suitably selected. Furthermore, dimensions and other characterizing properties of the guide rails 67, the wall fastenings 69, the drive frame 71, the floor fastenings 73, the cross struts 75, the longitudinal struts 77, the diagonal struts 79 and shaft doors and cab doors (not shown) can be selected appropriately. Associated data can be stored in the commission digital double data record.

The framework 5 can again function as an example of the MBOM generated from the EBOM. Production-specific rules concern, for example, the material qualities available at the production site or the present production quality of the means of production depending on the production site. Additionally, another influencing factor can be the production layout of the manufacturing facility, which may not allow all desirable production processes. Characterizing properties of the component model data records are modified accordingly, flow plans are added, and the like.

The production of the passenger transport system takes place on the basis of the production data (MBOM), with the production data being replaced by the physical data, e.g., actual values taken from the physical product, as production progresses. Here, for example, the real component dimensions and the assembly-relevant data such as tightening torques of screw connections, points of use of lubricants and the like are recorded and transferred to the digital double or commissioning digital double data record, thereby mutating it into the completion digital double data record. When the passenger transport system is delivered, a digital double or completion digital double data record exists in parallel to it, which ideally corresponds exactly to the physical product.

When installing the passenger transport system in the building and during commissioning, additional data such as the operating data and measurement data transmitted by sensors can be updated in the digital double, so that the completion digital double data record is mutated to the updated digital double data record. This happens continuously or periodically even after commissioning.

Periodic queries on the digital double such as wear-related geometric changes can be evaluated using collision simulations and maintenance work can be planned. Maintenance instructions for maintenance personnel can also be generated with the help of the digital double. Consequently, when components are replaced during maintenance, their component model data records are updated in the digital double of this passenger transport system with the actual data corresponding to the newly installed physical component. In the end, the individual components can be evaluated and disposed of in an environmentally friendly manner for further use, processing or disposal before the system is shut down.

Figure 4:
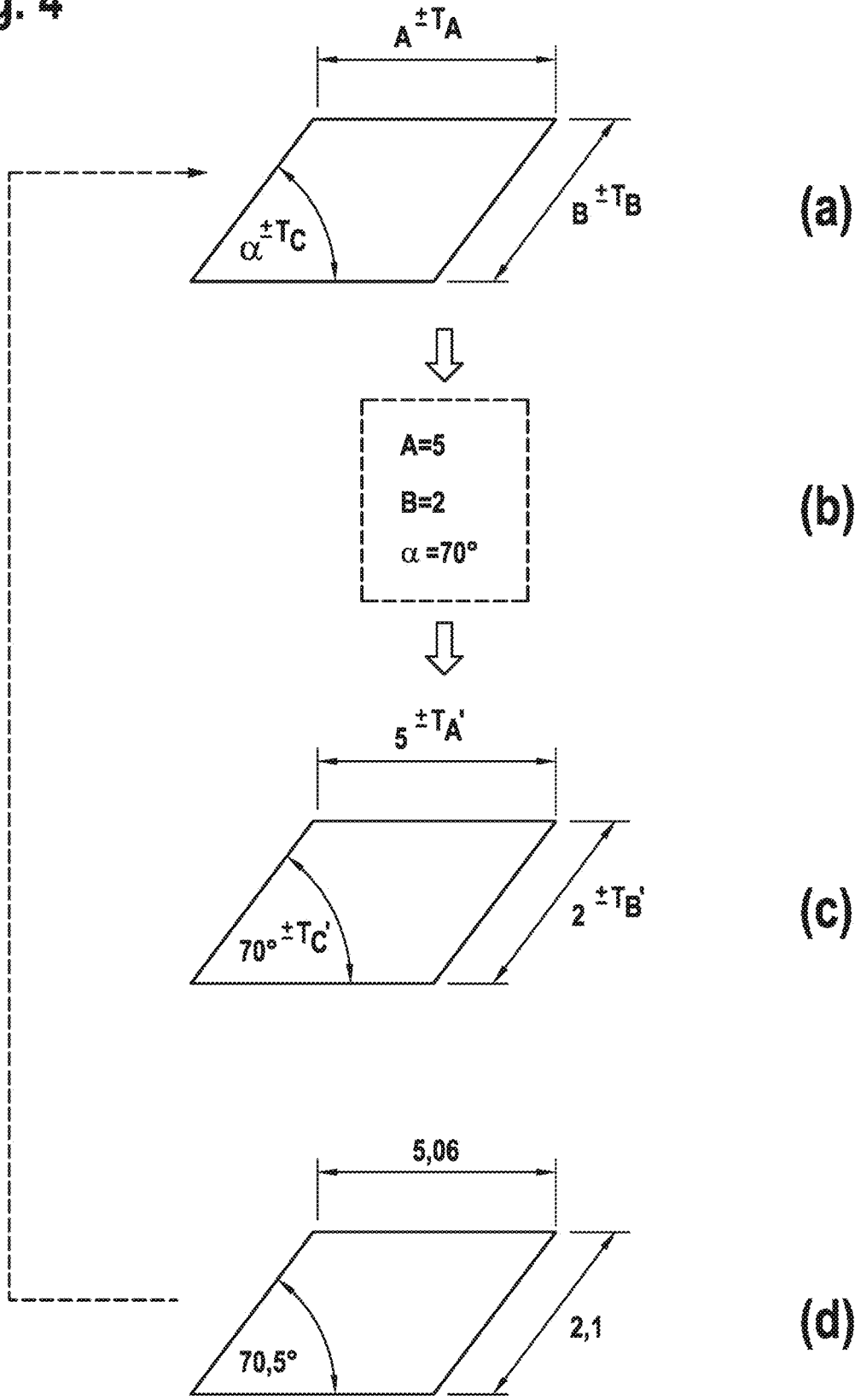
FIG. 4 illustrates the creation of a digital double data record using the example of a simplified component.

In order to clarify possible embodiments of method steps which are to be carried out when creating a digital double data record based on generic component model data records, this process is explained by way of example with reference to FIG. 4. It shows how a digital double data record is created for a very simple component in the form of a parallelogram-shaped sheet.

First, a generic component model data record is generated as part of a research and development (R&D) (see FIG. 4(*a*)). In doing so, planned values for the characterizing properties to be achieved are ascertained for the component. In the example shown, planned variables A, B, $\alpha$ of geometric properties, that is to say a width, a height, and an angle of the parallelogram, are ascertained. Furthermore, an associated tolerance range $T_A$, $T_B$, $T_C$ is determined for each planned variable. The sheet thickness is the same for all design variants of this component and thus belongs to the defined characterizing properties of this generic component model data record.

Then, customer specifications are determined during the distribution of the passenger transport system (see FIG. 4(*b*)). Based on these customer specifications, a planned value suitable for the specific passenger transport system is ascertained for each of the planned variables. In the example shown, the width is determined to A=5, the height to B=2, and the angle to $\alpha$=70°. This definition turns the generic component model data record into a defined component model data record; described by commissioning data. This defined component model data record can function as EBOM.

The commissioning data of the defined component model data record are then specified in such a way that the planned values previously ascertained only based on the customer specification are modified taking into account production specifications relative to production data. For example, material information from the country of production, an OEM manufacturer, or the like can be taken into account. Hereby, the commissioning data of the commissioning digital double data record are ultimately complemented in the form of an MBOM identified as production data, which can be used in the production of the component and serves as a virtual image of the component to be produced. In doing so, the ascertainment of tolerance specifications $T_A'$, $T_B'$, $T_C'$ also takes into account the production specifications that are actually prevailing during production.

Finally, at least some of the characterizing properties of the component produced using the production data are surveyed. In the case shown, the dimensions of the component are measured in their actual configuration (actual values) after their assembly to form the passenger transport system and the installation of the passenger transport system. Since the characterizing properties of the material do not change during production, it can only be checked, for example, whether the correct material was used, but without checking all the material properties such as tensile strength, shear strength, flexural fatigue strength, impact strength, corrosion behavior, crystalline structure, alloy components, and the like more. If necessary, the dimensions of the component in its actual configuration can also be repeatedly measured during operation of the passenger transport system based on sensor signals. Hereby, for example, deviations between the actual values on installed and possibly operated components can be ascertained from the associated planned values. In the example shown, such deviations are $\Delta A=0.06$, $\Delta B=0.1$ and $\Delta C=0.5°$.

The deviations found can, for example, be statistically analyzed for a plurality of components of a component type. Results can be taken into account, for example, when researching and developing a modified generic component model data record of the affected component type.

In other words, the data from many digital double evaluations can also be used to assess the robustness of the design of a component type.

Until now, this robustness could only be assessed, for example, with regard to the production quality, by checking whether production equipment corresponds to the required component quality by recording the actual dimensions of the physical components and comparing them with a tolerance band of the recorded dimensions. If, for example, the lengths of the same components of a component type are always within the tolerance limits, this either means that the means of production are not good enough or that the tolerance band was chosen too narrow.

The robustness of a component type can now also be assessed with regard to quality properties, that is, for example, quality of use, by using the digital doubles presented here, by assessing wear and/or failure of identical components of a component type. Here, not only can vulnerabilities be identified by means of statistical evaluations, but the full availability of the actual dimensions and the dynamic interaction of the components can also be used to determine possible causes of operational damage.

If, for example, a plain bearing is subject to excessive wear in a production series of passenger transport systems, the cause can be an excessive load due to the customer specification. However, it is also possible that the actual dimensions of the bore and axis of a built-in production lot cause the bearing gap to be too narrow or too large. It is also possible that another component, for example, a rail joint that is too large, has caused loads for which the plain bearing was not designed. The corresponding cause can be found by means of dynamic simulations and statistical evaluations on the digital doubles. The cause found can be taken into account in a change in the design of the component type concerned or in a change in adjacent components or in a change in the permissible customer specifications in the sales process (for example, a reduction in the maximum delivery head).

In summary, the method proposed here or a correspondingly configured apparatus allow the present state of a transport system to be monitored using the suitably created updated digital double data record, as a result of which maintenance measures can be planned more appropriately for the situation or corresponding to the actual requirements and thus considerable costs can be saved and/or whereby component types can be designed or modified in such a way that they better meet the requirements that actually arise in the operation of a passenger transport system.

Finally, it should be noted that terms such as "having," "comprising," etc. do not preclude other elements or steps and terms such as "a" or "an" do not preclude a plurality. Furthermore, it should be noted that features or steps that have been described with reference to one of the above embodiments can also be used in combination with other features or steps of other embodiments described above. Reference signs in the claims should not be considered limiting.

The invention claimed is:

1. A method for monitoring a state of a passenger transport system, the method comprising:

creating an updated digital double data record that reflects characterizing properties of components of the passenger transport system in a machine-processable manner and represents the passenger transport system in an actual configuration after its assembly and installation in a building, wherein creating the updated digital double data record comprises:

creating a commissioning digital double data record with planning data, which reflects the characterizing properties of components of the passenger transport system in a planned configuration;

creating a completion digital double data record based on the commissioning digital double data record by measuring actual data, which reflects characterizing properties of components of the passenger transport system in the actual configuration of the passenger transport system after the assembly and installation thereof in a building and replacing of planned data in the commissioning digital double data record with corresponding actual data; and creating the updated digital double data record based on the completion digital double data record by modifying the completion digital double data record during the operation of the passenger transport system taking into account measurement values, which reflects changes in the characterizing properties of components of the passenger transport system during operation; and monitoring a state of a passenger transport system by using the updated digital double data record, wherein, by monitoring, changes and trends in the characterizing properties of the components can be tracked and assessed.

2. The method of claim 1, wherein the updated digital double data record comprises data which were ascertained by measuring characterizing properties on the completed passenger transport system.

3. The method of claim 1, wherein the characterizing properties of a component are selected from a group comprising geometric dimensions of the component, weight of the component, material properties of the component and surface properties of the component.

4. The method of claim 1, wherein the monitoring of the state of the passenger transport system comprises simulating future characterizing properties of the passenger transport system by using the updated digital double data record.

5. The method of claim 1, further comprising planning of maintenance work to be carried out on the passenger transport system based on information about the monitored state of the passenger transport system.

6. The method of claim 1, further comprising assessing quality properties of a type of component based on an analysis of updated digital double data records of a plurality of passenger transport systems containing the component in question.

7. The method of claim 1, wherein the creation of the commissioning digital double data record comprises creating commissioning data taking into account customer specifications and creating production data by modifying the commissioning data taking into account production specifications.

8. The method of claim 7, wherein when the commissioning data is created, a virtual image of the passenger transport system is generated using generic component model data records of the passenger transport system and including the customer specifications.

9. The method of claim 7, wherein, when creating the commissioning data, at least one simulation is performed that is selected from a group comprising static and dynamic simulations, and wherein the commissioning digital double data record is created taking into account the results of the at least one simulation.

10. The method of claim 1, wherein the passenger transport system is selected from a group comprising escalators and moving walkways, and wherein the components of the passenger transport system are selected from a group comprising:

components of a framework comprising a plurality of components selected from a subgroup comprising upper straps, lower straps, uprights, cross struts, diagonal struts, gusset plates, support angles, and framework separation points; and components of a conveyor comprising at least one component selected from a subgroup comprising driving stages, driving pallets, conveyor chains, conveyor belts, deflection sprockets, deflection disks, drive machines, service brakes, and controllers.

11. The method of claim 1, wherein the passenger transport system is an elevator and wherein the components of the passenger transport system are selected from a group comprising:

components of a support structure comprising a plurality of components selected from a subgroup comprising guide rails, wall fastenings, drive frames, floor fastenings, cross struts, longitudinal struts, and diagonal struts; and components of a conveyor comprising at least one component selected from a subgroup comprising elevator cabs, counterweights, suspension devices, drive machines, braking apparatuses, and controllers.

12. An apparatus for monitoring a state of a passenger transport system, the apparatus being configured to monitor the state of the passenger transport system, wherein that monitoring is carried out by using an updated digital double data record that reflects characterizing properties of components of the passenger transport system in an actual configuration of the passenger transport system in a machine-processable manner after the assembly and installation thereof in a building, and that changes and change trends in the characterizing properties of components are traceable and assessable by monitoring, with the apparatus also being configured to produce the updated digital double data record step by:

creating a commissioning digital double data record having planning data, which reflects the characterizing properties of components of the passenger transport system in a planned configuration using generic component model data records and defined component model data records;

creating a completion digital double data record based on the commissioning digital double data record by measuring actual data, which reflects characterizing properties of components of the passenger transport system in the actual configuration of the passenger transport system directly after the assembly and installation thereof in a building and replacing of planning data in the commissioning digital double data record with corresponding actual data; and creating the updated digital double data record based on the completion digital double data record by modifying the completion digital double data record during the operation of the passenger transport system taking into account measurement values, which reflects changes in the characterizing properties of components of the passenger transport system during operation.

13. A passenger transport system, comprising the apparatus of claim 12.

14. A non-transitory computer readable medium comprising instructions that, when executed, configure a processor to monitor a state of a passenger transport system by:

creating an updated digital double data record that reflects characterizing properties of components of the passenger transport system in a machine-processable manner and represents the passenger transport system in an actual configuration after its assembly and installation in a building, wherein creating the updated digital double data record comprises:

creating a commissioning digital double data record with planning data, which reflects the characterizing properties of components of the passenger transport system in a planned configuration;

creating a completion digital double data record based on the commissioning digital double data record by measuring actual data, which reflects characterizing properties of components of the passenger transport system in the actual configuration of the passenger transport system after the assembly and installation thereof in a building and replacing of planned data in the commissioning digital double data record with corresponding actual data; and creating the updated digital double data record based on the completion digital double data record by modifying the completion digital double data record during the operation of the passenger transport system taking into account measurement values, which reflects changes in the characterizing properties of components of the passenger transport system during operation; and monitoring a state of a passenger transport system by using the updated digital double data record, wherein, by monitoring, changes and trends in the characterizing properties of the components can be tracked and assessed.

* * * * *